US011187491B2

(12) United States Patent
Salvitti

(10) Patent No.: US 11,187,491 B2
(45) Date of Patent: Nov. 30, 2021

(54) TACTICAL PEN WEAPON

(71) Applicant: Alfred W. Salvitti, Glen Riddle, PA (US)

(72) Inventor: Alfred W. Salvitti, Glen Riddle, PA (US)

( * ) Notice: Subject to any disclaimer, the term of this patent is extended or adjusted under 35 U.S.C. 154(b) by 0 days.

(21) Appl. No.: 16/783,634

(22) Filed: Feb. 6, 2020

(65) Prior Publication Data

US 2020/0256634 A1 Aug. 13, 2020

Related U.S. Application Data

(60) Provisional application No. 62/918,668, filed on Feb. 8, 2019.

(51) Int. Cl.

| | |
|---|---|
| ***B43K 29/00*** | (2006.01) |
| ***F41B 13/00*** | (2006.01) |
| ***B43K 29/18*** | (2006.01) |

(52) U.S. Cl.
CPC ..... *F41B 13/00* (2013.01); *B43K 29/18* (2013.01)

(58) Field of Classification Search
CPC ..... B43K 29/18; F41B 13/00
USPC ..... 401/195, 8
See application file for complete search history.

(56) References Cited

U.S. PATENT DOCUMENTS

| | | | | |
|---|---|---|---|---|
| 6,640,450 | B2 * | 11/2003 | Teague | B43K 29/18 30/123 |
| 9,108,454 | B1 | 8/2015 | Rosenberg | |
| 9,428,002 | B2 * | 8/2016 | Rosenberg | B43K 29/18 |
| 10,569,597 | B2 * | 2/2020 | Yang | B43K 29/18 |
| 2001/0019967 | A1 * | 9/2001 | Taylor | F41B 15/02 463/47.2 |

* cited by examiner

*Primary Examiner* — Jennifer C Chiang
(74) *Attorney, Agent, or Firm* — Norman E. Lehrer

(57) ABSTRACT

A highly concealable handheld tactical pen weapon having the appearance and aesthetics of a pen-like instrument but which contains a hinging element which allows a rear ring-like element to rotate up to almost one hundred eighty degrees to the main body of the pen. The articulating ring provides a finger hold which allows the weapon to be used more effectively in a thrusting movement.

5 Claims, 3 Drawing Sheets

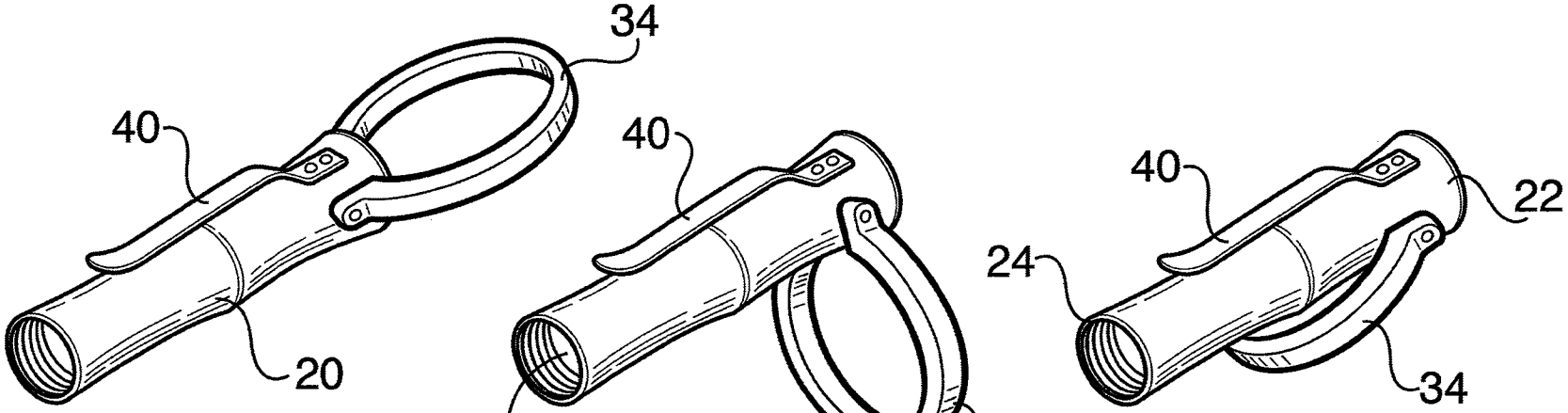
FIG 3
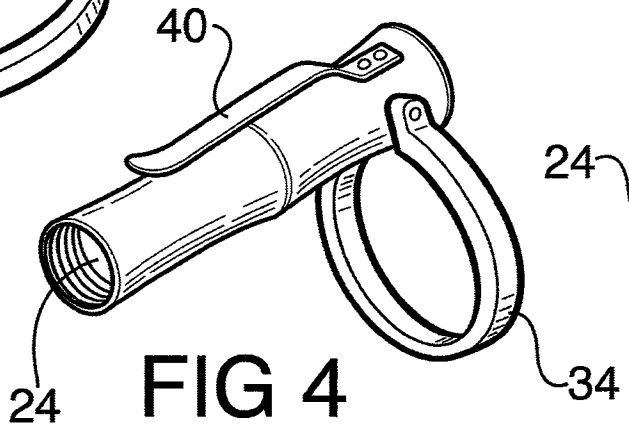
FIG 4
FIG 5
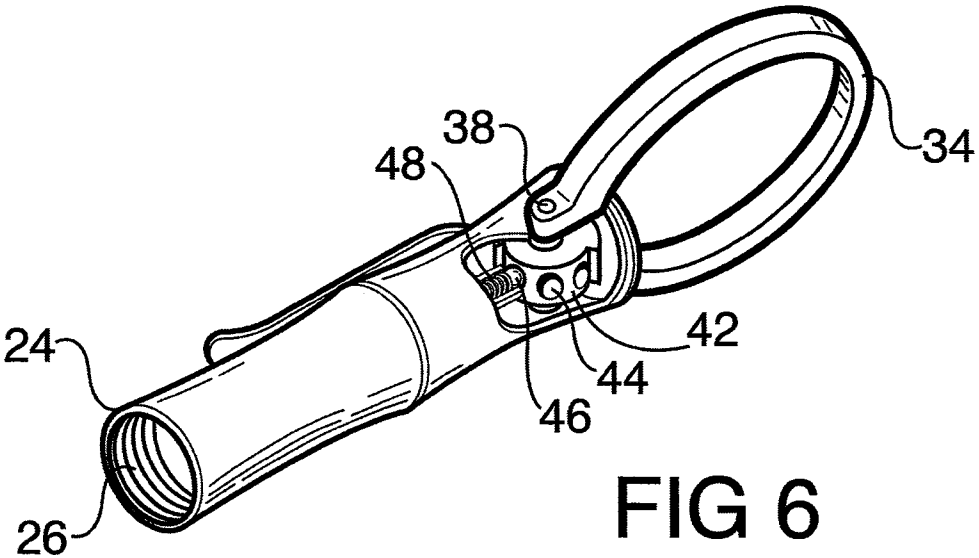
FIG 6

TACTICAL PEN WEAPON

CROSS-REFERENCE TO RELATED APPLICATION

This application claims the benefit of prior Provisional Application Ser. No. 62/918,668, filed Feb. 8, 2019.

FIELD OF THE INVENTION

The invention relates to a tactical pen instrument which may be configured as a writing instrument with combat-oriented features.

BACKGROUND OF THE INVENTION

Tactical pens can be traced back to a Japanese inventor of a tactical key chain weapon many decades ago. The original discreet personal weapon was called a kubotan. While it was a pen-shaped object that could easily be placed on a key chain to give you a discreet weapon in times of need. That classic device featured several finger grips along a cylinder but with a flat end at one side for the key chain and a tapered, dull point on the other side. In the hands of the right operator, such a device could do serious damage and was considered a passive defensive weapon without being an edged weapon such as a knife.

Since that time, tactical pens were inspired by that early Japanese invention. A tactical pen is a writing instrument with combat-oriented features. Typically, tactical pens have a heavier weight than ordinary pens and they are designed with superior durability. While they are built to withstand physical abuse and contact, many still can operate as a pen or at least appear to be exactly like a pen when worn in a pocket.

Most tactical pens are used for self-defense. Such a weapon is designed to be carried in the situation where conventional weaponry, including edged weapons, are not allowed or would be otherwise prohibited. Tactical pens are popular among individuals who need to frequently access controlled environments like airports and the like where other kinds of weapons would not be allowed. However, tactical pens are not classified as weapons because they contain no sharp blades or edges other than a point which resembles ballpoint or similar end but which is made of durable material such as a metal tip or hard plastic or fiberglass.

SUMMARY OF THE INVENTION

The disclosed invention relates to a passive tactical weapon commonly referred to as a tactical pen having the aesthetic appearance of a pen-like instrument which can be placed in the pockets of a person's clothing. The invention is different than present tactical pens which may be available on the market in that the end of the pen opposite the pointed end is comprised of an appendage which allows greater hold on the pen so that it may be thrust without slipping through the user's hands.

The invention is comprised of a cylindrical body made of durable rigid material that is elongated in the shape and about the size of a large pen. The front end or leading end of the pen is pointed, either by having an actual ballpoint pen protruding therefrom or having a point-like surface simulating a ballpoint pen. The point is typically covered in a barrel-like snap on or screwed on cap which covers the pointed end such as a common ballpoint pen may have a cap slid over the point and containing such accoutrements such as a pocket clip to allow the weapon to be carried in a certain pocket, for example.

The third major member of the invention is a flared, ring-like device which is used to either pull the weapon out of the cap or pocket and to also assist in retaining the weapon by placing the user's fingers therethrough.

In a preferred embodiment, and as shown by the various figures, the ring is sufficient to allow a single finger to be placed so that the tactical pen is retained and may be drawn to and fro without losing a grip thereon.

In the most preferred embodiment, the ring can be pivoted between several different positions and includes detent means for maintaining the ring in any one of the different positions.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

FIGS. 3, 4 and 5 are perspective views of the improved end cap of the invention showing the ring pivoted between three different positions;

FIG. 6 is a perspective view with a portion broken away illustrating the mechanism for maintaining the ring in the different positions.

DETAILED DESCRIPTION OF THE PREFERRED EMBODIMENT

Figures 1, 2:
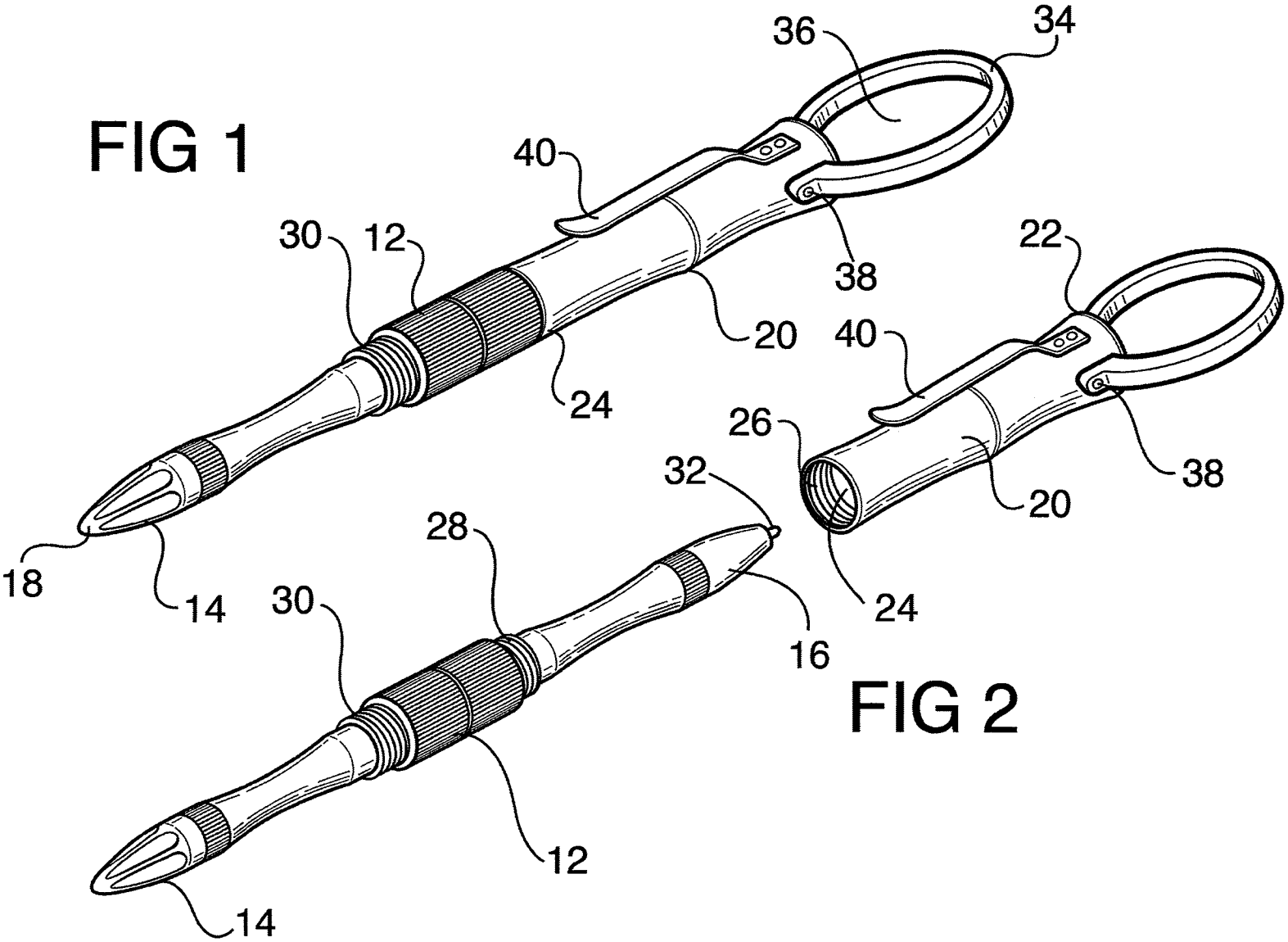
FIG. 1 is a perspective view of a tactical pen with a conventional cap covering one end of the pen and the improved cap of the invention covering the other end thereof.
FIG. 2 is an exploded view similar to FIG. 1 but with the caps removed from the pen.

Referring now to the drawings in detail wherein like reference numerals have been used throughout the various figures to designate like elements, there is shown in FIGS. 1-8 a tactical pen constructed in accordance with the principles of the present invention and designated generally as 10.

The tactical pen 10 is comprised of an elongated barrel 12 having a longitudinal axis and which resembles that of a conventional ball point pen. The barrel 12 has a first end 14 and a second end 16. A hard and relatively sharp tip 18 is located at the first end 14 and is capable of being used as a weapon as is well known in the art. The tip 18 may be made of metal, plastic or fiberglass or other hard material.

A cap 20 has a closed end 22 and an open end 24 and is capable of covering and being selectively attachable to either the first end 14 of the barrel 12 or to the second end 16 of the barrel 12. In the embodiment shown, the open end 24 of the cap 20 includes an internal thread 26 which can be threaded onto either the external thread 28 or 30 of the barrel 12. This, however, is by way of example only. It is possible to have other connecting structures such as the cap 20 simply snapping onto either end 14 or 16 of the barrel similar to the manner in which a cap can be snapped onto a ball point pen or the like.

The second end 16 of the barrel 12 may be constructed so as to essentially be a ball point pen and includes a ball point 32. Thus, the tactical pen 10 can also be used simply as a conventional ball point pen. This can be done either with the cap 20 off as shown in FIG. 2 or with the cap 20 attached to the first end 14 of the barrel 12.

Figure 8:
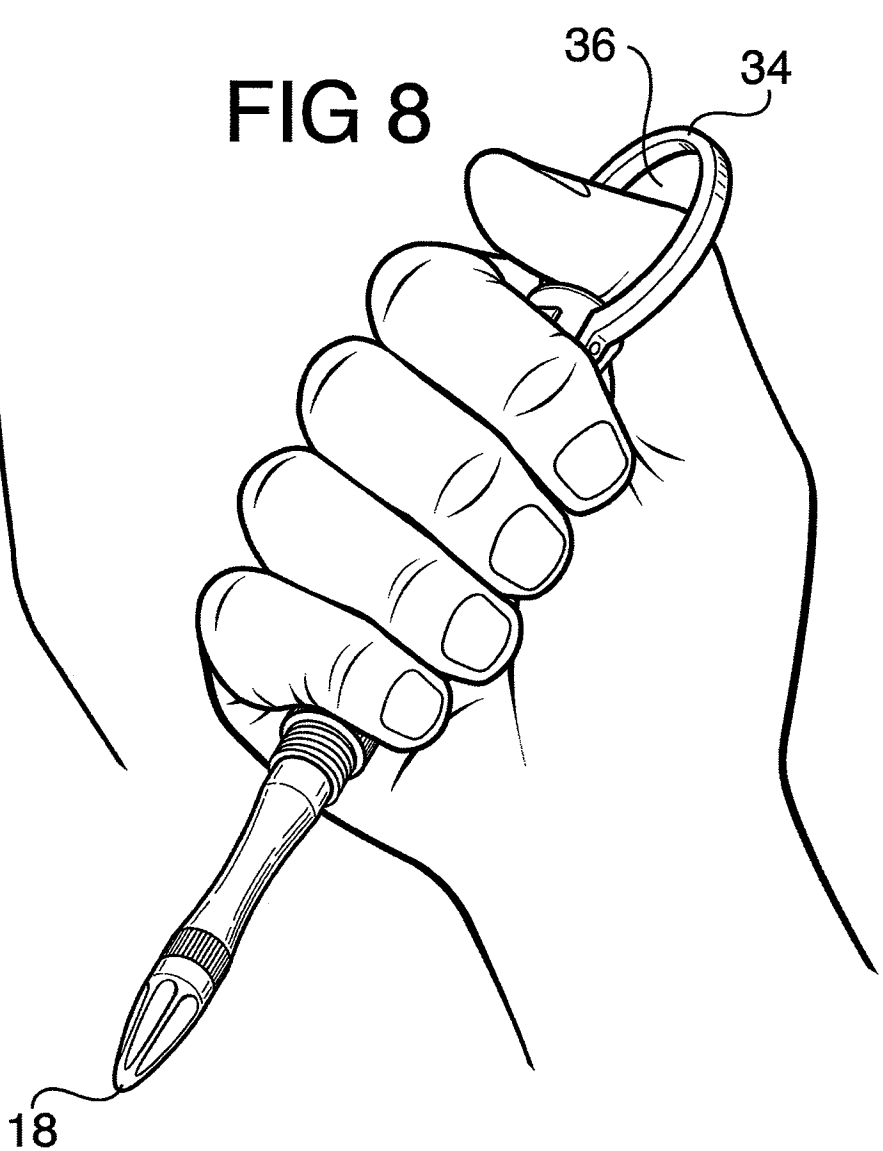
FIGS. 7 and 8 are perspective views showing the manner in which the tactical pen of the invention can be grasped for use.
Figure 7:
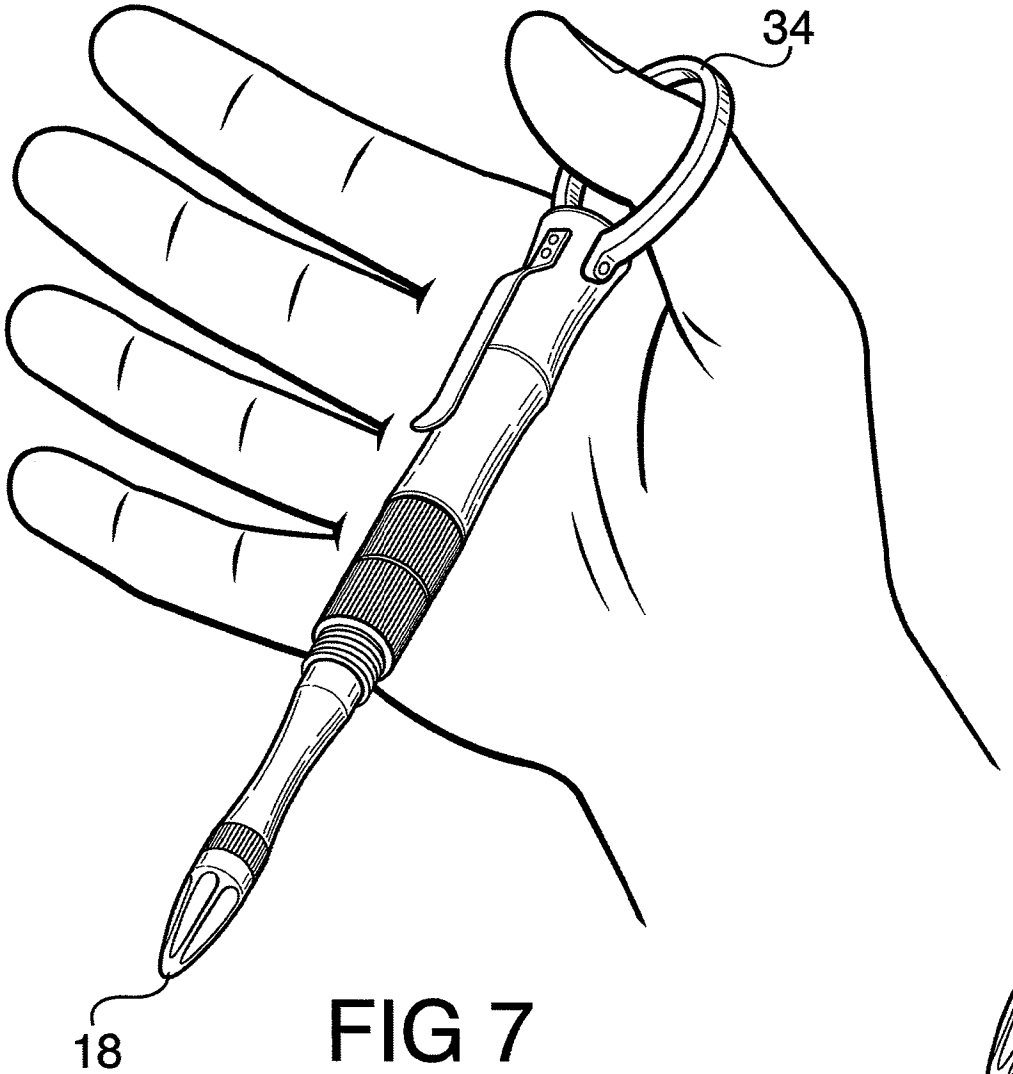

A finger ring 34 is pivotally secured to the closed end 22 of the cap 20 through the use of a pivot pin or the like such as shown at 38. The finger ring 34 has an opening 36 therein which is large enough for the average person to place his or her finger or thumb through the same such as shown in FIGS. 7 and 8.

As shown most clearly in FIGS. 3, 4 and 5, the finger ring 34 is capable of rotating or pivoting between several fixed positions. In FIG. 3, the finger ring 34 extends outwardly in axial alignment with the cap 20 and the barrel 12 when the cap 20 is placed on the barrel 12 such as shown in FIG. 1. FIG. 4 shows the finger ring 34 extending sideways away from the axis and FIG. 5 shows the finger ring 34 rotated almost 180° so as to be located adjacent the cap 20.

Each of the positions of the finger ring 34 shown in FIGS. 3, 4 and 5 serves a particular purpose. In the position shown in FIG. 3, a person's thumb can pass through the finger ring as shown in FIGS. 7 and 8 so as to be grasped and used as a weapon. In the position shown in FIG. 4, the finger ring 34 can be exposed when the tactical pen is in a person's pocket so that it can be removed easily and can also serve to help grasp the tactical pen and holding the same in various different positions with the person's thumb or finger passing through the opening 36. In FIG. 5, the finger ring 34 can function as a clip to hold the tactical pen 10 in a person's pocket with the pocket fabric material lying between the finger ring 34 and the cap 20. In other words, the finger ring as shown in FIG. 5 could function as a pocket clip in lieu of the spring clip 40.

Means are also provided for maintaining the finger ring 34 in the positions shown in FIGS. 3, 4 and 5. By way of example, the pivot pin 38 can be connected to a small wheel 42 located within the second end 22 of the cap 20. The outer circumference of the wheel 42 includes a plurality of detents 44 therein. In the embodiment shown in FIG. 6, there are three such detents which correspond to the positions shown in FIGS. 3, 4 and 5. As the finger ring 34 and, thus, the wheel 42 is rotated, a ball 46 biased by a spring 48 enters the detent and retains the finger ring 34 in place.

The foregoing mechanism shown in FIG. 6 is, of course, by way of example only. There are numerous other similar mechanisms that could be utilized. The simplest mechanism, for example, could simply be a tight friction fit between the finger ring 34 and the second end 22 of the cap 20 so that the finger ring 34 would remain in any position in which it is placed. Furthermore, while three different positions are shown in FIGS. 3, 4 and 5, it should be understood that this is also by way of example only. It is possible, for example, to design the finger ring 34 and end cap 20 so that only two or more than three possible positions can be achieved.

It can be appreciated by those skilled in combat arts that having a tactical pen which allows greater forward thrusts through the application of a lateral stroke on a suitable bearing surface such as provide by the invention can provide a method of fighting and use of a tactical pen that allows applying maximum forward force without injuring the palm of the user.

Although the invention has been described in accordance with the preferred embodiment, it will be appreciated by those skilled in the art that the application of the present invention is useful in a variety of configurations and designs not specifically described above. All such designs and applications are considered to be within the scope of the present disclosure, and the invention is applicable across a wide variety of applications. Such applications are considered within the scope and spirit of the present invention.

In as far as a description above and the accompanying drawings disclose any additional subject matter that is not within the scope of the claims below, the inventions are not dedicated to the public and the right to file other applications to claim any additional inventions is reserved.

I claim:

1. A tactical pen weapon comprising:

an elongated barrel having a longitudinal axis and resembling that of a conventional ball point pen, said barrel having a first end and a second end;

a hard point at said first end and being capable of being used as a weapon;

a cap, said cap having a closed end and an open end, said open end being capable of covering and being selectively attachable to said first end of said barrel and to said second end of said barrel, and a finger ring attached to said closed end of said cap, said ring being pivotable between several positions and including means for maintaining said ring in each of said several positions.

2. The tactical pen weapon as claimed in claim 1 wherein in one of said positions said ring extends outwardly in alignment with said axis.

3. The tactical pen weapon as claimed in claim 1 wherein in one of said positions said ring is rotated so as to be located adjacent said cap.

4. The tactical pen weapon as claimed in claim 1 wherein in one of said positions said ring extends outwardly away from said axis.

5. The tactical pen weapon as claimed in claim 1 wherein said second end of said barrel includes a writing pen point carried thereon.

* * * * *